US009803926B2

(12) United States Patent
Kikuchi et al.

(10) Patent No.: US 9,803,926 B2
(45) Date of Patent: Oct. 31, 2017

(54) SUPPORT MECHANISM AND SUBSTRATE PROCESSING APPARATUS

(71) Applicant: Tokyo Electron Limited, Tokyo (JP)

(72) Inventors: Hiroshi Kikuchi, Iwate (JP); Yoshiyuki Kobayashi, Iwate (JP)

(73) Assignee: Tokyo Electron Limited, Tokyo (JP)

( * ) Notice: Subject to any disclaimer, the term of this patent is extended or adjusted under 35 U.S.C. 154(b) by 151 days.

(21) Appl. No.: 14/604,866

(22) Filed: Jan. 26, 2015

(65) Prior Publication Data

US 2015/0211796 A1 Jul. 30, 2015

(30) Foreign Application Priority Data

Jan. 28, 2014 (JP) ..... 2014-013738

(51) Int. Cl.
*F27D 1/18* (2006.01)
*F27B 17/00* (2006.01)

(52) U.S. Cl.
CPC ..... *F27D 1/1808* (2013.01); *F27B 17/0025* (2013.01)

(58) Field of Classification Search
CPC ..... F27D 1/1808; F27B 17/0025
See application file for complete search history.

(56) References Cited

U.S. PATENT DOCUMENTS 5,224,999 A * 7/1993 Shiraiwa ..... C23C 16/4409 118/715
5,253,843 A * 10/1993 Garceau ..... F16K 5/201 251/159
5,571,330 A * 11/1996 Kyogoku ..... H01L 21/67098 118/715
5,796,074 A * 8/1998 Edelstein ..... C23C 16/4586 219/390
6,764,572 B2 * 7/2004 Shimizu ..... H01L 21/67069 156/345.1
2002/0182870 A1 * 12/2002 Matsunaga ..... H01L 21/67781 438/700

(Continued)

FOREIGN PATENT DOCUMENTS

JP 53-16251 U 4/1978
JP 05-021421 A 1/1993

(Continued)

OTHER PUBLICATIONS

JP2004311509A—machine translation.*

*Primary Examiner* — Nathaniel Herzfeld
(74) *Attorney, Agent, or Firm* — Abelman, Frayne & Schwab

(57) ABSTRACT

The present disclosure provides a support mechanism for supporting a cover that performs sealing of a furnace opening of a heat treatment furnace or release the sealing by being moved up or down by an elevating unit. The support mechanism includes a first elastic body having a first elastic modulus; and a second elastic body having a second elastic modulus larger than the first elastic modulus. A reaction force in relation to the first elastic body is applied to the cover when the cover abuts on the furnace opening by being moved up by the elevating unit, and a reaction force in relation to the first elastic body and the second elastic body is applied to the cover after the cover abuts on the furnace opening by being moved up by the elevating unit.

6 Claims, 6 Drawing Sheets

(56) References Cited

U.S. PATENT DOCUMENTS

| | | | | |
|---|---|---|---|---|
| 2003/0000476 | A1* | 1/2003 | Matsunaga | C23C 16/54 118/719 |
| 2011/0179717 | A1* | 7/2011 | Taniyama | H01L 21/67757 49/324 |
| 2011/0182615 | A1* | 7/2011 | Morishita | G03G 21/1842 399/111 |
| 2011/0240225 | A1* | 10/2011 | Yamada | B65H 23/0322 156/390 |

FOREIGN PATENT DOCUMENTS

| | | | | |
|---|---|---|---|---|
| JP | 09-148261 | A | | 6/1997 |
| JP | 2003-309078 | A | | 10/2003 |
| JP | 2004311509 | A | * | 11/2004 |
| JP | 2010-238900 | A | | 10/2010 |

* cited by examiner

SUPPORT MECHANISM AND SUBSTRATE PROCESSING APPARATUS

CROSS-REFERENCE TO RELATED APPLICATIONS

This application is based on and claims priority from Japanese Patent Application No. 2014-013738, filed on Jan. 28, 2014 with the Japan Patent Office, the disclosure of which is incorporated herein in its entirety by reference.

TECHNICAL FIELD

The present disclosure relates to a support mechanism and a substrate processing apparatus.

BACKGROUND

In manufacturing semiconductor devices, processings such as, for example, a film forming processing, an oxidation processing, a diffusion processing, an annealing processing, and an etching processing, are performed on a substrate which is a workpiece (e.g., a semiconductor wafer (hereinafter, referred to as a "wafer")). In general, these processings are performed in a vertical substrate processing apparatus including a heater device, which is able to process a plurality of wafers in a batch type.

The substrate processing apparatus generally includes a sealed storage container (e.g., FOUP) that stores wafers to be conveyed to the substrate processing apparatus from a previous step, a wafer boat that stores the wafers during a processing, and a loading area where wafer transfer is performed between the storage container and the wafer boat. A process tube (processing container) and a heater device are provided in an upper space of the loading area. The wafer boat that stores the wafers is disposed in the process tube through an elevating mechanism.

In general, below the wafer boat, a cover is formed integrally with the wafer boat to cap a manifold provided on an opening side of the process tube in order to maintain the airtightness in the heater device during the substrate processing. When the manifold is capped by the cover, it is required that the cover elastically abuts on the manifold. Further, after being abutted, the cover needs to be closely adhered to the manifold with a predetermined degree of adhesion (see, e.g., Japanese Patent Laid-Open Publication No. H05-21421).

SUMMARY

According to an aspect, the present disclosure provides a support mechanism for supporting a cover that performs sealing of a furnace opening of a heat treatment furnace or release the sealing by being moved up or down by an elevating unit. The support mechanism includes a first elastic body having a first elastic modulus; and a second elastic body having a second elastic modulus larger than the first elastic modulus. A reaction force in relation to the first elastic body is applied to the cover when the cover abuts on the furnace opening by being moved up by the elevating unit, and a reaction force in relation to the first elastic body and the second elastic body is applied to the cover after the cover abuts on the furnace opening by being moved up by the elevating unit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
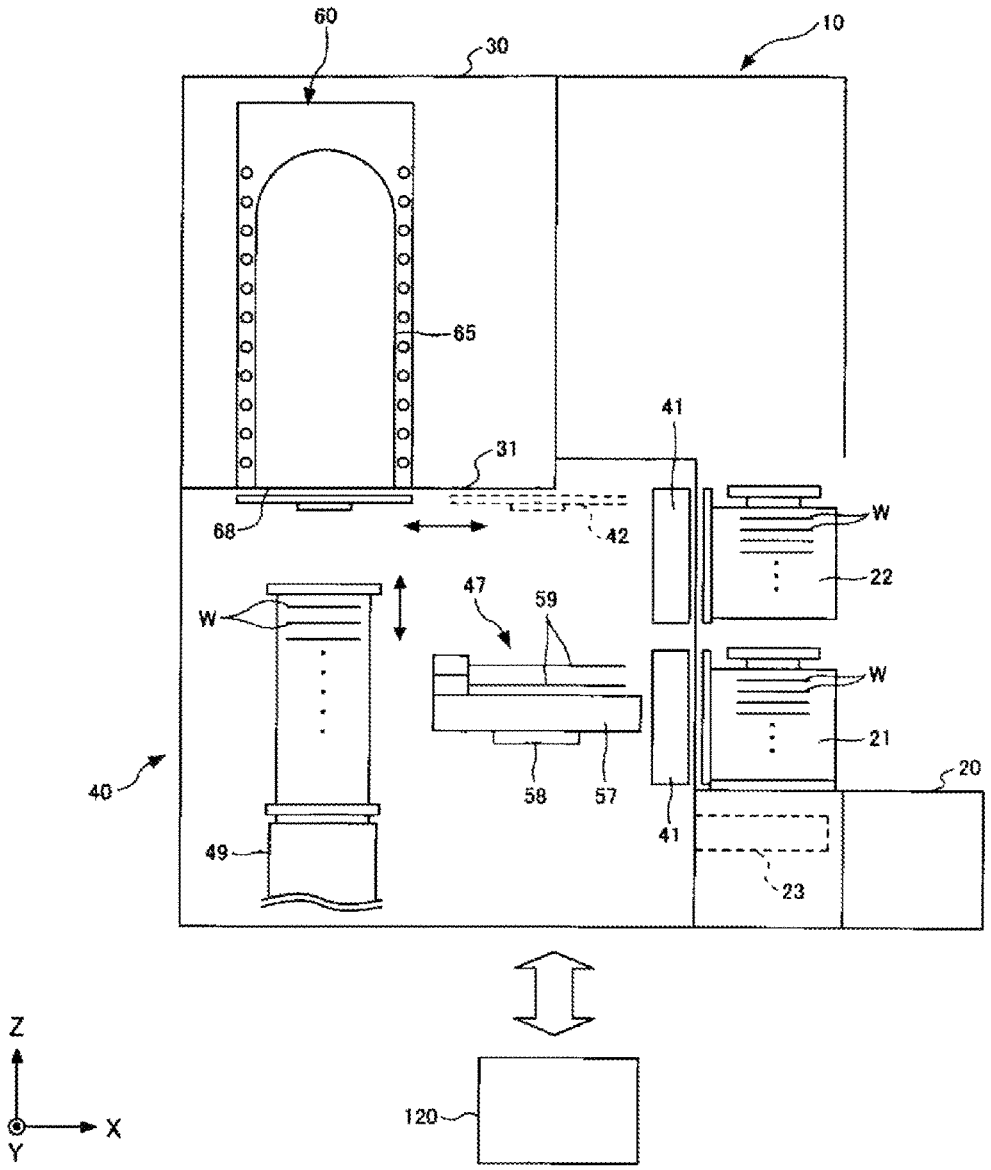
FIG. 1 is a schematic view illustrating an exemplary substrate processing apparatus according to an aspect of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

In the method of Japanese Patent Laid-Open Publication No. H05-21421, it was difficult to achieve the elastic abutment of the cover on the manifold and the airtightness maintaining property at the same time.

In order to solve the problem, the present disclosure provides a support mechanism which can achieve the elastic abutment of the cover on the manifold and the airtightness maintaining property at the same time.

According to an aspect, the present disclosure provides a support mechanism for supporting a cover that performs sealing of a furnace opening of a heat treatment furnace or release the sealing by being moved up or down by an elevating unit. The support mechanism includes a first elastic body having a first elastic modulus; and a second elastic body having a second elastic modulus larger than the first elastic modulus. A reaction force in relation to the first elastic body is applied to the cover when the cover abuts on the furnace opening by being moved up by the elevating unit, and a reaction force in relation to the first elastic body and the second elastic body is applied to the cover after the cover abuts on the furnace opening by being moved up by the elevating unit.

The support mechanism further includes a first support member provided to be spaced downwardly apart from the cover and configured to be moved up/down when the elevating unit is moved up/down. The first elastic body is in contact with the cover at one end, and in contact with a first surface of the first support member facing the cover at the other end. The second elastic body is in contact with the first surface of the first support member at one end.

The support mechanism further includes a second support member provided to be spaced downwardly apart from the cover and configured to be moved up/down when the elevating unit is moved up/down; a third support member provided to be spaced downwardly apart from the second support member and configured to be moved up/down when the elevating unit is moved up/down; and a fourth support member including a base portion provided between the second support member and the third support member and a connecting portion connecting the base portion and the cover such that a distance between the base portion and the cover is set to be a predetermined distance. The first elastic body is in contact with the cover at one end, and in contact with a second surface of the second support member facing the cover at the other end. The second elastic body is in contact with a third surface of the third support member facing the base portion at one end.

In the above-described support mechanism, the first elastic modulus is in a range of 35 kgf/cm$^2$ to 400 kgf/cm$^2$, and the second elastic modulus is in a range of 100 kgf/cm$^2$ to 1,500 kgf/cm$^2$.

In the above-described support mechanism, a ratio of the first elastic modulus to the second elastic modulus is in a range of 2 to 20.

According to another aspect, the present disclosure provides a substrate processing apparatus including a heat treatment furnace; a cover configured to perform sealing of a furnace opening of the heat treatment furnace or release the sealing; a support mechanism configured to support the cover; and an elevating unit configured to move up/down the cover through the support mechanism. The support mechanism includes a first elastic body having a first elastic modulus; and a second elastic body having a second elastic modulus larger than the first elastic modulus. A reaction force in relation to the first elastic body is applied to the cover when the cover abuts on the furnace opening by being moved up by the elevating unit, and a reaction force in relation to the first elastic body and the second elastic body is applied to the cover after the cover abuts on the furnace opening by being moved up by the elevating unit.

According to the present disclosure, it is possible to provide a support mechanism which can achieve the elastic abutment of the cover on the manifold and the airtightness maintaining property at the same time.

Hereinafter, exemplary embodiments of the present disclosure will be described with reference to the drawings attached herewith. First, a whole schematic configuration of an example of the substrate processing apparatus according to the present exemplary embodiment will be described with reference to FIGS. 1 and 2. Then, a schematic configuration of a portion around a cover 43 and a support mechanism 50 according to the present exemplary embodiment will be described with reference to FIGS. 3 to 6. Meanwhile, FIG. 2 illustrates a configuration of a portion around the cover 43 for ease of description.

(Substrate Processing Apparatus)

Figure 2:
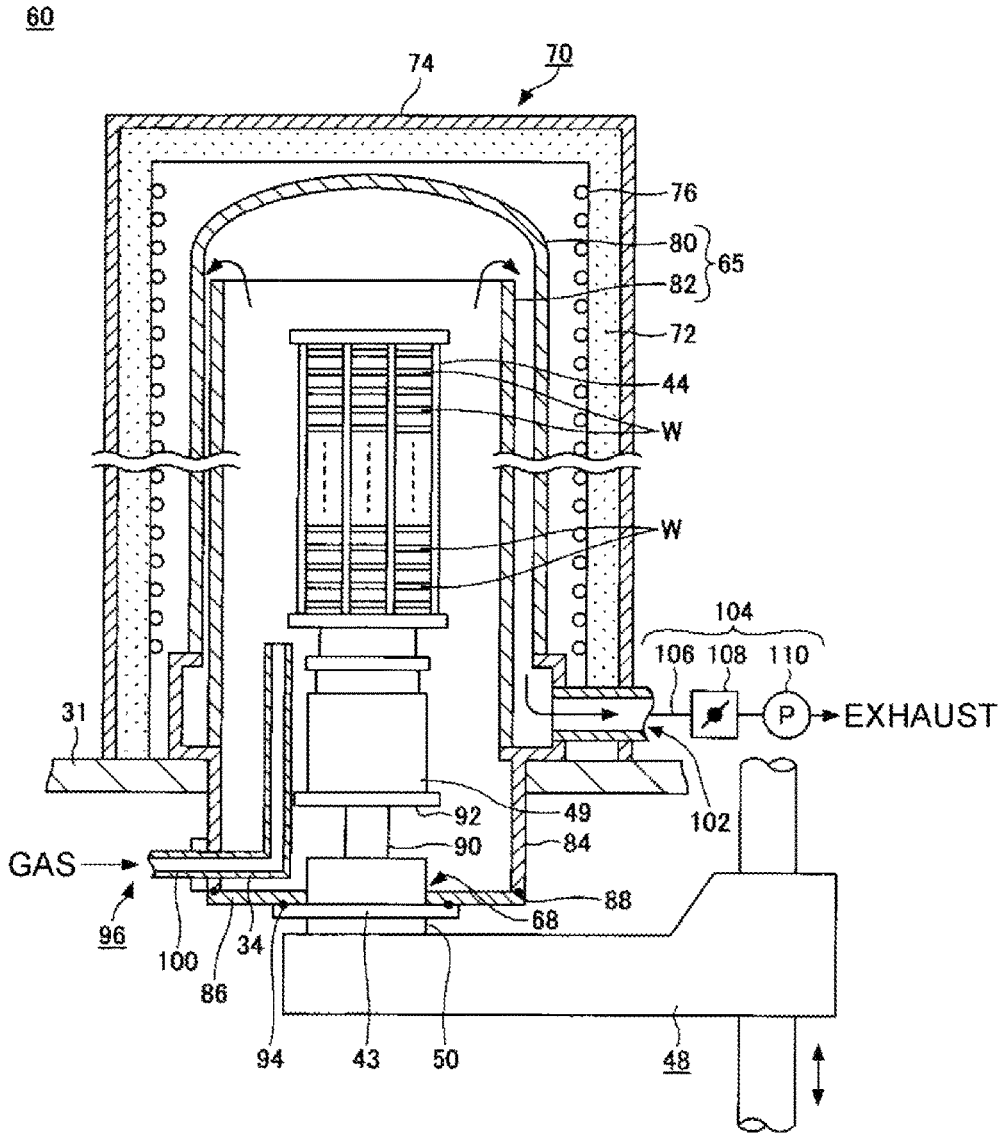
FIG. 2 is a schematic view illustrating another exemplary heat treatment furnace according to the present aspect.

FIG. 1 is a schematic view illustrating an exemplary vertical substrate processing apparatus according to an aspect of the present disclosure. Meanwhile, in FIG. 1, descriptions will be made assuming that the X axis direction is the forward direction of the forward and rearward directions, and the Z axis direction is the upward direction of the upward and downward directions (or elevating direction). Further, FIG. 2 is a schematic view illustrating another exemplary heat treatment furnace according to the present aspect.

A substrate processing apparatus 10 includes a placing table (load port) 20, a housing 30, and a control unit 120.

The placing table 20 is provided in front of the housing 30 to carry wafers W into or out of the housing 30. The placing table 20 is configured such that a sealed storage containers (FOUPs; also referred to as "substrate conveyance apparatuses") 21, 22 configured to store a plurality (e.g., about twenty five (25) sheets) of wafers W at a predetermined intervals are aligned in the Z axis direction or the X axis direction. In an example illustrated in FIG. 1, two sealed storage containers 21, 22 are provided in the Z axis direction.

The sealed storage containers 21, 22 are storage containers that carry wafers W into a loading area 40 (to be described later) of the substrate processing apparatus 10 from a previous step or carry the wafers W out from the substrate processing apparatus 10 to a subsequent processing, and are provided with detachable covers on their front sides.

Further, an alignment device (aligner) 23 may be provided below the placing table 20 to align cutout portions (e.g., notches) formed on the outer periphery of the wafers W transferred by a transfer mechanism 47 (to be described later), in one direction.

The loading area 40, which serves as a working region, is formed in the rear region of the placing table 20. The loading area 40 refers to a region where wafers W are transferred between the storage containers 21, 22 and a wafer boat 44 (to be described later). In addition, a heat treatment furnace 60 is provided above the loading area 40 to perform various heat treatments on the wafers W stored in the wafer boat 44. Further, a base plate 31 is provided between the loading area 40 and the heat treatment furnace 60.

As described above, the loading area 40 is a region where wafers W are transferred between the storage containers 21, 22 and the wafer boat 44 (to be described later). The loading area 40 includes door mechanisms 41, a shutter mechanism 42, a cover 43, the wafer boat 44, the transfer mechanism 47, and an elevating mechanism 48.

The door mechanisms 41 remove covers (not illustrated) of the sealed storage containers 21, 22 so that the sealed storage containers 21, 22 are opened to be in communication with the loading area 40.

The shutter mechanism 42 is provided in the upper region of the loading area 40 and below the base plate 31. The shutter mechanism 42 is provided to block a furnace opening 68 when the cover 43 is opened (that is, the cover 43 is moved downward) in order to control a radiation of heat in the furnace from the furnace opening 68 to the loading area 40.

The cover 43 is provided below the wafer boat 44 integrally with the wafer boat 44. More particularly, a heat insulation cylinder 49 is provided below the wafer boat 44 to suppress the wafer boat 44 from being cooled due to heat transfer with the cover 43 side. In addition, a table 92 made of, for example, a stainless steel is fixed below the heat insulation cylinder 49, and the cover 43 is provided below the table 92 which is in turn provided below a shaft 90.

Further, the support mechanism 50 is provided below the cover 43 to support the cover 43. The support mechanism 50 that supports the cover 43 will be described later in detail. Meanwhile, the wafer boat 44 disposed above the cover 43 may rotatably hold wafers W on the horizontal surface in the processing container 65.

The wafer boat 44 is made of, for example, quartz, and configured to mount therein wafers W having a large diameter, for example, a diameter of 450 mm or 300 mm vertically at a predetermined intervals and in a horizontal state. In general, the number of wafers W to be stored in the wafer boat 44 is not limited, but, for example, about 50 to 150 sheets. FIG. 1 illustrates the substrate processing apparatus 10 is configured to have one wafer boat 44. However, the substrate processing apparatus 10 may have a plurality of wafer boats 44.

The transfer mechanism 47 transfers the wafers W between the sealed storage containers 21, 22 and the wafer boat 44. The transfer mechanism 47 includes a base 57, an elevating arm 58, and a plurality of forks (transfer plates) 59. The base 57 is provided to be elevatable and pivotable. The elevating arm 58 is provided to be elevatable, and the base 57 is provided to be horizontally pivotable around the elevating arm 58.

The elevating mechanism 48 is, for example, a boat elevator, and moves up and down the wafer boat 44 (and the cover 43) when carry-in/out of the wafer boat 44 including wafers W transferred thereto is performed with respect to the heat treatment furnace 60 from the loading area 40. The elevating mechanism 48 is engaged with the support mechanism 50, and may move up and down the wafer boat 44 and the cover 43 through the support mechanism 50. The cover 43 moved up by the elevating mechanism 48 abuts on a cap 86, which is provided in an opening of a lower portion of a manifold 84 (to be described later), to seal the furnace opening 68. A seal member 94 such as, for example, an O-ring, is provided between the cover 43 and the cap 86.

After various processings of the wafers W are terminated, the wafer boat 44 is moved down to the lower region of the loading area 40. That is, the elevating mechanism 48 may move up and down the wafer boat 44 between a load position positioned in the heat treatment furnace 60 (see the position of the wafer boat 44 in FIG. 2) and an unload position positioned outside the heat treatment furnace 60 and below the load position (see the position of the wafer boat 44 in FIG. 1). Meanwhile, the sealing of the furnace opening 68 by the cover 43 according to the present exemplary embodiment will be described in detail together with the configuration of the support mechanism 50 according to the present aspect.

The heat treatment furnace 60 is a batch type vertical furnace for storing a plurality of wafers W and performing a predetermined heat treatment, and includes the processing container 65. The processing container 65 is supported by the base plate 31 through the manifold 84 (to be described later) (see FIG. 2).

Next, an exemplary configuration of the heat treatment furnace 60 section of the substrate processing apparatus 10 according to the present aspect will be described in detail with reference to FIG. 2.

In the exemplary configuration illustrated in FIG. 2, the vertical heat treatment furnace 60 includes a processing container, of which the longitudinal direction is vertical, and a heater device 70 provided at the outer peripheral side of the processing container 65 to surround the processing container 65.

The processing container 65 is configured as a double pipe structure having an outer cylinder 80 with a ceiling and a cylindrical inner cylinder 82 disposed concentrically at the inner peripheral side of the outer cylinder 80.

The outer cylinder 80 and the inner cylinder 82 are made of a heat-resistant material such as, for example, quartz. Further, the outer cylinder 80 and the inner cylinder 82 are held at their lower ends by a manifold made of, for example, stainless steel.

An annular cap 86 made of, for example, a stainless steel is attached hermetically to the lower end opening of the manifold 84 through a sealing member such as, for example, an O-ring. A central opening of the annular cap 86 corresponds to the furnace opening of the heat treatment furnace 60.

The heat treatment furnace 60 is provided with a gas introducing unit 96 to introduce a processing gas into the processing container 65. The gas introducing unit 96 includes a gas nozzle 100 that is provided to hermetically penetrate the manifold 84. Meanwhile, although FIG. 2 illustrates the exemplary provided with one gas introducing unit 96, the present disclosure is not limited thereto. A plurality of gas introducing units 96 may be provided depending on the number of gas species used. Further, the flow rate of a gas introduced form the gas nozzle 100 into the processing container 65 is controlled by a flow rate control mechanism (not illustrated).

Further, the heat treatment furnace 60 includes a gas outlet 102 connected with an exhaust system 104. The exhaust system 104 includes an exhaust passage 106 connected to the gas outlet 102, and a pressure adjusting valve 108 and a vacuum pump 110 which are sequentially connected in the middle of the exhaust passage 106. The internal atmosphere of the processing container 65 may be exhausted by the exhaust system 104 while controlling the pressure.

The heater device 70 is provided at the outer peripheral side of the processing container 65 to surround the processing container 65, thereby performing a heat treatment on workpieces such as wafers W.

The heater device 70 includes a cylindrical thermal insulation wall 72. The thermal insulation wall 72 may be made of, for example, a mixture of alumina and amorphous silica, which is flexible and has a low thermal conductivity.

The thermal insulation wall 72 is disposed such that its inner peripheral surface is spaced apart from the outer peripheral surface of the processing container 65 by a predetermined distance. Further, a protective cover 74 made of, for example, a stainless steel is attached to the outer peripheral surface of the thermal insulation wall 72 to cover the entire outer periphery of the thermal insulation wall 72.

A heater element 76 is provided on the inner peripheral surface of the thermal insulation wall 72 to be wound multiple times. For example, the heater element 76 is formed in a spiral shape using the central axis of the cylindrical thermal insulation wall 72 as an axis.

Further, a holding member (not illustrated) may be provided on the thermal insulation wall 72 along the axial direction of the thermal insulation wall 72 in order to hold the heater element 76 at a predetermined pitch. Alternatively, a groove may be formed on the inner peripheral side of the thermal insulation wall 72 to hold the heater element 76 which is accommodated therein.

The heater device 70 is generally divided into several zones in the axial direction, and configured to be able to control the temperature in each zone.

The substrate processing apparatus 10 according to the present aspect includes a control unit 120. The control unit 120 includes, for example, an operation processing unit, a memory unit, and a display unit. The operation processing unit is, for example, a computer having a central processing unit (CPU). The memory unit is a computer-readable recording medium configured by, for example, a hard disc which records a program for causing the operation processing unit to execute various processings. The display unit is, for example, a computer screen. The operation processing unit reads out the program recorded in the memory unit, and transmits a control signal to each part constituting the substrate processing apparatus in response to the program, thereby performing various heat treatments.

First Exemplary Embodiment

Next, an exemplary embodiment of a portion around the cover 43 and the support mechanism 50 according to the present aspect will be described with reference to drawings.

[Problems of Conventional Support Mechanism 450]

Figure 3A:
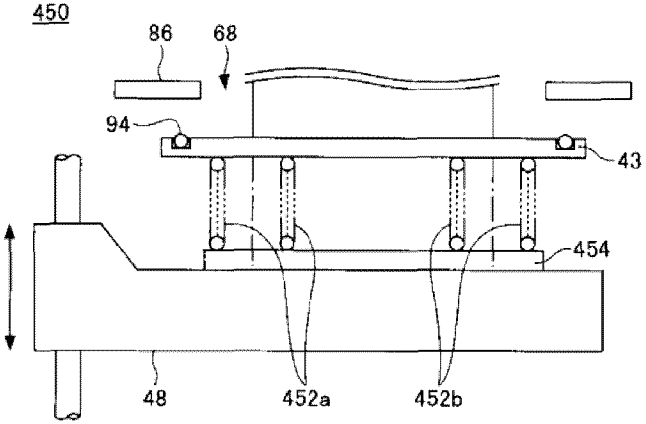
FIG.3A Prior Art
FIGS. 3A to 3C are schematic views illustrating a portion around a conventional support mechanism.
Figure 3B:
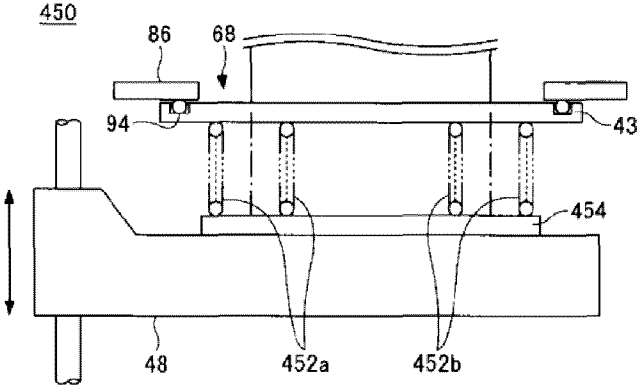
FIG.3B Prior Art
Figure 3C:
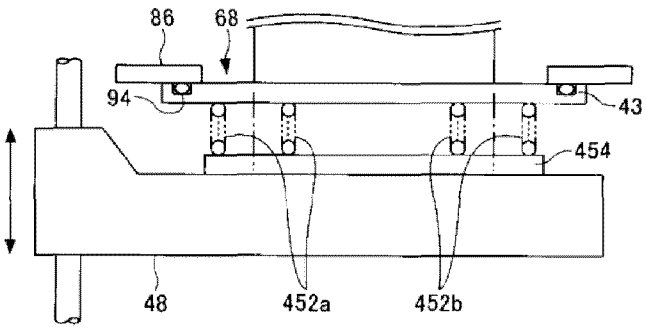
FIG.3C Prior Art

First, problems of sealing of a furnace opening by a cover using a conventional support mechanism 450 will be described with reference to FIGS. 3A to 3C. FIGS. 3A to 3C are schematic views illustrating a portion around the conventional support mechanism 450. FIG. 3A is a schematic view before a cover 43 abuts on a cap 86 when the cover 43 is elevated by an elevating mechanism 48, FIG. 3B is a schematic view immediately after the cover 43 abuts on the cap 86, and FIG. 3C is a schematic view illustrating a state where the cover 43 seals a furnace opening 68 sufficiently.

In FIGS. 3A to 3C, the configuration of the manifold 84 above the cap 86 and the cover 43 will be omitted for simplification of description.

As illustrated in FIGS. 3A to 3C, the conventional support mechanism 450 includes elastic members 452*a*, 452*b* such as, for example, spring members, each of which is in contact with the cover 43 at one end, and a support member 454 (also referred to as a "cap base") which is in contact with the other end to support the elastic members 452*a*, 452*b*.

In the example illustrated in FIGS. 3A to 3C, the elastic members 452*a*, 452*b* are provided in two sites with respect to the cover 43. Without being limited thereto, however, the elastic members 452*a*, 452*b* may be provided at three or more sites along the circumference of the cover 43. Each of the elastic members 452*a*, 452*b* has the same elastic modulus.

An elevating mechanism 48 is provided below the support member 454, and the cover 43 and the elastic members 452*a*, 452*b* are moved up through the support member 454.

In the conventional support mechanism 450, in order to securely seal the furnace opening 68 by the cover 43, elastic moduli of all the elastic members 452*a*, 452*b* are designed to have values corresponding to a pressing force enough to crush a seal member 94. Therefore, even in a state where the cover 43 is prior to abutment on the cap 86 as illustrated in FIG. 3A, a reaction force of the pressing force is applied to the cover 43. Particularly, wafers having a large diameter, for example, a diameter of 450 mm or 300 mm have been demanded, and the weight of the wafers W also has been increasing in response to the demand. That is, a load above the cover 43 (e.g., the weight of the wafer boat 44 storing the wafers W) has been increasing, and hence, the elastic moduli of all the elastic members 452, 452*b* have been increasing in order to securely seal the furnace opening 68 by the cover 43.

When the cover 43 abuts on the cap 86 by being further moved up as illustrated in FIG. 3A in a state where the elastic moduli of the elastic members 452*a*, 452*b* are large enough to securely seal the furnace opening 68, the cover 43 may not abut on the cap 86 elastically (or with soft touch, or smoothly).

It is considered to slow down the elevation speed of the elevating mechanism 48 as a method of allowing the cover 43 to elastically abut on the cap 86. In this case, however, the throughput is reduced. Further, it is also considered to reduce a deflection amount during the incorporation of the elastic members 452*a*, 452*b* into the support mechanism 50. In this case, however, it is necessary to increase the thickness of the cover 43. Therefore, the height of the apparatus is increased. Further, since the time required for cap closing by the cover 43 increases, the throughput decreases.

Even in a case where the conventional support mechanism 450 is used, the secure sealing of the furnace opening 68 by the cover 43 may be achieved by crushing the sealing member 94 sufficiently as illustrated in FIG. 3C.

Through the close examination on the problems in the related arts, the inventors have found that the elastic abutment of the cover on the manifold and the airtightness maintaining property may be achieved at the same time by using a support mechanism including a first elastic body having a first elastic modulus and a second elastic body having a second elastic modulus larger than the first elastic modulus, and controlling the timing when a reaction force is applied to a cover from each elastic body.

That is, the support mechanism according to the present exemplary embodiment is a support mechanism configured to support a cover that performs sealing of a furnace opening of a heat treatment furnace or release the sealing by moving-up/down of an elevating unit. The support mechanism includes a first elastic body having a first elastic modulus, and a second elastic body having a second elastic modulus larger than the first elastic modulus. A reaction force in relation to the first elastic body is applied to the cover when the cover moved up by the elevating unit abuts onto the furnace opening, and a reaction force in relation to the first elastic body and the second elastic body is applied to the cover after the cover moved up by the elevating unit abuts on the furnace opening.

For details of the support mechanism according to the present exemplary embodiment, specific exemplary embodiments will be described as follows with reference to the drawings.

[Configuration of Support Mechanism 50*a* According to First Exemplary Embodiment]

Figure 4:
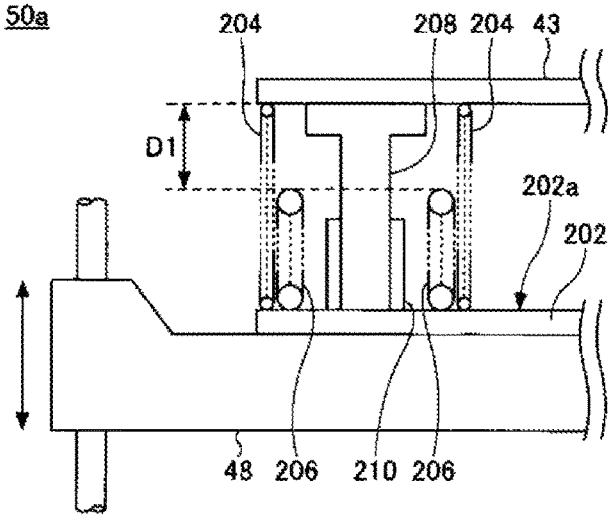
FIG. 4 is a schematic view illustrating a portion around a support mechanism according to a first exemplary embodiment.

An exemplary configuration and effects of a support mechanism 50*a* according to a first exemplary embodiment will be described with reference to FIGS. 4 and 5A to 5C. FIG. 4 is a schematic view illustrating a portion around the support mechanism 50*a* according to the first exemplary embodiment.

The support mechanism 50*a* according to the first exemplary embodiment is provided with a first elastic body and a second elastic body which are arranged in parallel in the elevating direction. Specifically, the support mechanism 50*a* includes a first support member 202 provided to be spaced downwardly apart from the cover 43 and configured to be moved up/down in response to the moving-up/down of the elevating mechanism; a first elastic body 204 having a first elastic modulus, in which the first elastic body 204 is in contact with the cover 43 at one end, and in contact with a first surface 202*a* of the first support member 202 facing the cover 43 at the other end; and a second elastic body 206 having a second elastic modulus larger than the first elastic modulus, in which the second elastic body 206 is in contact with the first surface 202*a* of the first support member 202 at one end.

Further, a reaction force in relation to the first elastic body 204 is applied to the cover 43 when the cover 43 abuts on the furnace opening 68 by being moved up by the elevating mechanism 48 and, and a reaction force in relation to the first elastic body 206 and the second elastic body 208 is applied to the cover 43 after the cover 43 abuts on the furnace opening 68 by being moved up by the elevating mechanism 48.

Meanwhile, the description "a reaction force in relation to the second elastic body 208 is applied to the cover 43 after the cover 43 abut on the furnace opening 68 by being moved up by the elevating mechanism 48" means that the reaction force in relation to the second elastic body 206 is not applied to the cover 43, for example, due to a clearance D1 illustrated in FIG. 4 when (or before) the cover 43 abuts on the furnace opening 68.

Figure 5B:
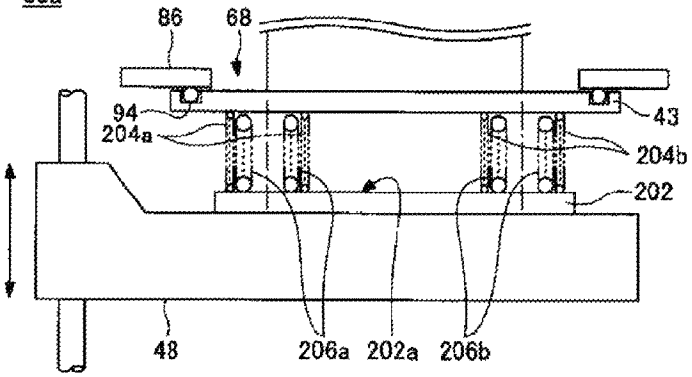
FIGS. 5A to 5C schematically illustrate exemplary effects of the support mechanism according to the first exemplary embodiment.
Figure 5A:
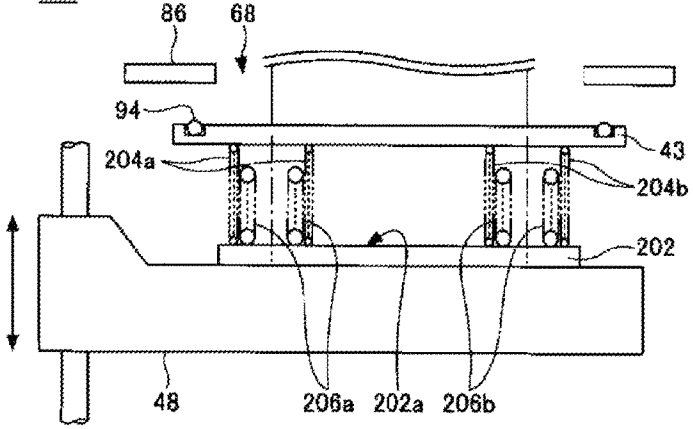
Figure 5C:
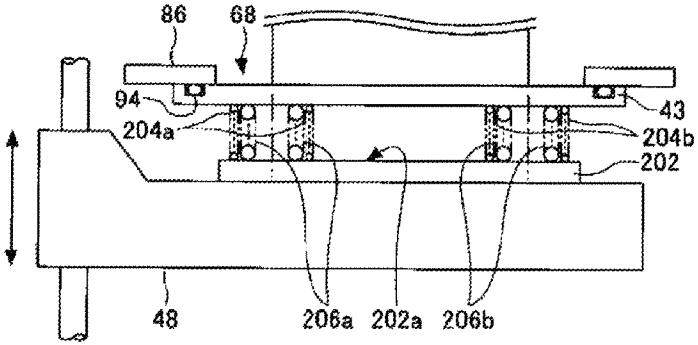

Effects of the support mechanism 50*a* according to the first exemplary embodiment will be described with reference to FIGS. 5A to 5C. FIGS. 5A to 5C schematically illustrate exemplary effects of the support mechanism 50*a* according to the first exemplary embodiment. FIG. 5A is a schematic view before the cover 43 abuts on the cap 86 while the cover 43 is elevated by the elevating mechanism 48, FIG. 5B is a schematic view after the cover 43 abuts on the cap 86 and immediately before the second elastic body 206 abuts on the cover 43, and FIG. 5C is a schematic view illustrating a state where the cover 43 seals the furnace opening 68 sufficiently.

FIGS. 5A to 5C illustrate an example in which two first elastic bodies 204 and two second elastic bodies 206, each of which is illustrated in FIG. 4, are arranged along the circumferential direction of the cover 43, in which the former will be referred to as "first elastic bodies 204*a*, 204*b*" and the latter will be referred to as "second elastic bodies 206*a*, 206*b*". However, the present disclosure is not limited thereto. Three or more (e.g., six) first elastic bodies 204 and three or more (e.g., six) second elastic bodies 206, each of which is illustrated in FIG. 4, may be arranged along the circumferential direction of the cover 43.

As illustrated in FIG. 5A, when the cover 43 does not seal the furnace opening 68, the second elastic bodies 206*a*, 206*b* are spaced apart from the cover 43 (see the clearance D1). That is, the second elastic bodies 206*a*, 206*b* are not in contact with the cover 43. Hence, in the state illustrated in FIG. 5A, a reaction force corresponding to the first elastic bodies 204*a*, 204*b* is applied to the cover 43, but a reaction force corresponding to the second elastic bodies 206*a*, 204*b* is not applied thereto.

When the cover 43 and the first support member 202 are moved up by the elevating mechanism 48 from the state illustrated in FIG. 5A, the cover 43 abuts on the cap 86 only in response to the elastic modulus of the first elastic bodies 204*a*, 204*b*. Therefore, the cover 43 may abut on the cap 86 elastically (or with soft touch, or smoothly) by the support mechanism 50*a* according to the present exemplary embodiment.

When the first support member 202 is further moved up by the elevating mechanism 48 in a state where the cover 43 abuts on the cap 86, the first elastic bodies 204*a*, 204*b* are deflected in response to the move-up increment. Then, when the first support member 202 is moved up by the same move-up increment as the clearance D1, the second elastic bodies 206*a*, 206*b* are brought into contact with the cover 43, as illustrated in FIG. 5B.

When the support mechanism 50*a* is further moved up by the elevating mechanism 48 from the state illustrated in FIG. 5B, a reaction force corresponding to the sum of the first elastic modulus and the second elastic modulus is applied to the cover 43. As a result, the seal member 94 may be sufficiently crushed, so that the furnace opening 68 may be hermetically sealed by the cover 43.

The first elastic modulus of the first elastic bodies 204*a*, 204*b* may be selected by a person skilled in the art depending on the material of the sealing member 94 or the elevation speed by the elevation mechanism 48 as long as the cover 43 (and the sealing member 94) can abut on the cap 86 elastically (or with soft touch or smoothly). Specifically, when a load on the cover 43 is within a range of, for example, 30 kgf to 300 kgf, the first elastic modulus may be set within a range of 35 kgf/cm$^2$ to 400 kgf/cm$^2$.

The second elastic modulus of the second elastic bodies 206*a*, 206*b* is not particularly limited as long as the sum of the first elastic modulus of the elastic bodies 204*a*, 204*b* and the second elastic modulus of the second elastic bodies 206*a*, 206*b* is a value enough to crush the sealing member 94, and may be selected by a skilled person depending on the material of the sealing member 94 or the elevation speed by the elevation mechanism 48. Specifically, when a load on the cover 43 is within a range of, for example, 100 kgf to 1,500 kgf, the first elastic modulus may be set within a range of, for example, 150 kgf/cm$^2$ to 2,000 kgf/cm$^2$.

Further, the ratio of the second elastic modulus to the first elastic modulus is preferably in a range of 2 to 5, more preferably in a range of 2 to 10, and still more preferably in a range of 2 to 20.

A coiled spring member may be used as the first elastic bodies 204*a*, 204*b* and the second elastic bodies 206*a*, 206*b*.

The clearance D1 is not particularly limited, but may be in a range of, for example, 1 mm to 20 mm The support mechanism 50*a* according to the present exemplary embodiment may include a shaft 208 and a bush guide 210, as illustrated in FIG. 4.

The shaft 208 is a member configured to suppress or reduce expansion and contraction of the first elastic bodies 204*a*, 204*b* and the second elastic bodies 206*a*, 206*b* in a rectangular direction to the axis and guide the expansion and contraction in the axial direction.

The second elastic bodies 206*a*, 206*b* of coiled spring members may be disposed at the inner peripheral sides of the first elastic bodies 204*a*, 204*b* of coiled spring members, respectively, and the shaft 208 may be disposed at the inner peripheral sides of the second elastic bodies 206*a*, 206*b*.

The bush guide 210 is disposed at the outer peripheral side of the shaft 208 to be in contact with the shaft 208, and configured to be shorter than the axial length of the shaft 208. Accordingly, the difference between the axial length of the shaft 208 and the axial length of the bush guide 210 becomes the maximum contraction amount of the first elastic bodies 204*a*, 204*b* and the second elastic bodies 206*a*, 206*b*.

As described above, the support mechanism 50*a* according to the first exemplary embodiment includes the first elastic bodies 204*a*, 204*b* configured to allow the cover 43 to elastically abut on the cap 86 and the second elastic bodies 206*a*, 206*b* configured to hermetically seal the cover 43 to the cap 86. Therefore, the elastic abutment of the cover 43 on the manifold and the airtightness maintaining property may be achieved at the same time.

Second Exemplary Embodiment

A support mechanism 50*b* according to a second exemplary embodiment will be described with reference to FIGS. 6A to 6D. FIGS. 6A to 6D schematically illustrate exemplary effects of the support mechanism 50*b* according to the second exemplary embodiment. In FIGS. 6A to 6D, components other than the essential structure in the support mechanism 50*b* will be omitted.

The support mechanism 50*b* according to the second exemplary embodiment is different from that of the first exemplary embodiment in that two kinds of elastic bodies having different elastic moduli are arranged in series in the elevating direction.

More particularly, the support mechanism 50*b* according to the second exemplary embodiment includes a second support member 302 provided to be spaced downwardly apart from the cover and configured to be moved up/down in response to the moving up/down of the elevating mechanism 48; a third support member 304 provided to be spaced downwardly apart from the second support member 302 and configured to be moved up/down in response to the moving up/down of the elevating mechanism 48; a fourth support member 306 including a base portion 306*a* provided between the second support member 302 and the third support member 304 and a connecting portion 306*b* connecting the base portion 306*a* and the cover 43 such that a distance between the base portion 306*a* and the cover 43 is set to be a predetermined distance; third elastic bodies 308*a*, 308*b* having a third elastic modulus, in which each of the third elastic bodies 308*a*, 308*b* is in contact with the cover 43 at one end, and in contact with a third surface 304*a* of the second support member 302 facing the cover 43 at the other end; and fourth elastic bodies 310*a*, 310*b* having a fourth elastic modulus larger than the third elastic modulus, in which each of the fourth elastic bodies 310*a*, 310*b* is in contact with a third surface 304*a* of the third support member 304 facing the base portion 306*a* at one end.

Further, a reaction force in relation to the third elastic bodies 308*a*, 308*b* is applied to the cover 43 when the cover 43 abuts on the furnace opening 68 by being moved up by the elevating mechanism 48, and a reaction force in relation to the fourth elastic bodies 310*a*, 310*b* and the third elastic bodies 308*a*, 308*b* is applied to the cover 43 after the cover 43 abuts on the furnace opening 68 by being moved up by the elevating mechanism 48.

Figure 6A:
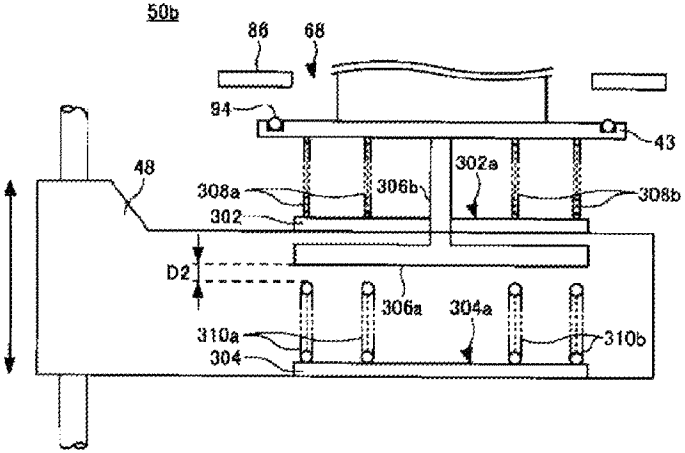
FIGS. 6A to 6D schematically illustrate exemplary effects of a support mechanism according to a second exemplary embodiment.

Effects of the support mechanism 50*b* according to the second exemplary embodiment will be described with reference to FIGS. 6A to 6D. FIG. 6A is a schematic view before the cover 43 abuts on the cap 86 while the cover 43 is elevated by the elevating mechanism 48, FIG. 6B is a schematic view immediately before (or immediately after) the cover 43 abuts on the cap 86, FIG. 6C is a schematic view after the cover 43 abuts on the cap 86 and immediately before the fourth elastic bodies 310*a*, 31*b* abut on the second support member 302, and FIG. 6D is a schematic view illustrating a state where the cover 43 seals the furnace opening 68 sufficiently.

As illustrated in FIG. 6A, when the cover 43 does not seal the furnace opening 68, the fourth elastic bodies 310*a*, 310*b* are spaced apart from the base portion 306*a* (have a predetermined clearance D2). Whereas, the third elastic bodies 308*a*, 308*b* are in direct contact with the cover 43. Hence, in the state illustrated in FIG. 6A, a reaction force only corresponding to the third elastic bodies 308*a*, 308*b* is applied to the cover 43. In other words, in the state illustrated in FIG. 6A, a reaction force corresponding to the fourth elastic bodies 310*a*, 310*b* is not applied to the cover 43.

Figure 6B:
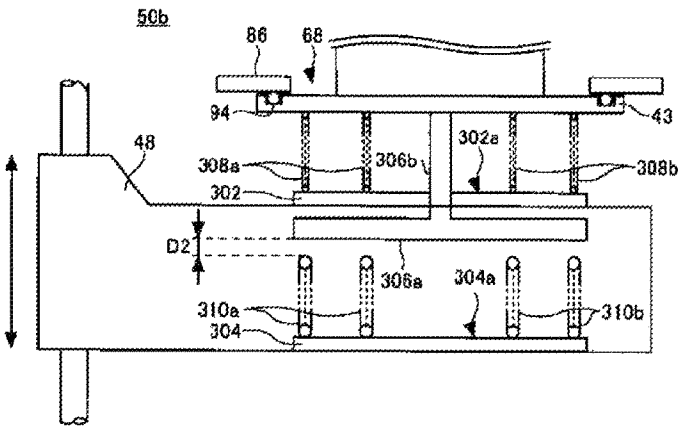
Figure 6C:
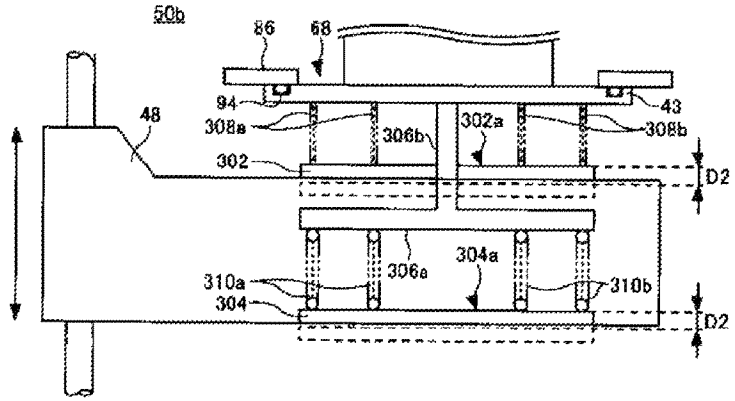
Figure 6D:
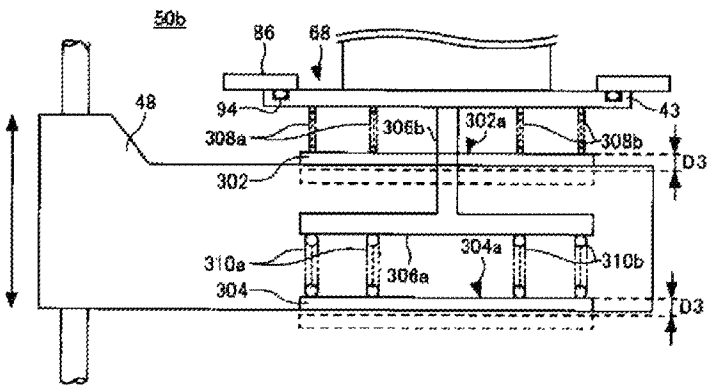

The cover 43, the second support member 302, and the third support member 304 are moved up by the elevating mechanism 48 from the state illustrated in FIG. 6A, so that the cover 43 abuts on the cap 86 as illustrated in FIG. 6B. In the state illustrated in FIG. 6B, a reaction force only in relation to the third elastic bodies 308*a*, 308*b* is applied to the cover 43 as in the first exemplary embodiment. Therefore, the abutment of the cover 43 on the cap 86 through the sealing member 94 is performed elastically (or with soft touch, or smoothly). That is, the cover 43 may abut on the cap 86 elastically (or with soft touch, or smoothly) by the support mechanism 50*b* according to the present exemplary embodiment.

In the state where the cover 43 abuts on the cap 86 as illustrated in FIG. 6B, the second member 302 and the third member 304 are further moved up by the elevating mechanism 48 (the cover 43 is moved up by an amount corresponding to a crushed amount of the sealing member 94). By the move-up of the second support member 302, the third elastic bodies 308*a*, 308*b* are deflected in response to the move-up amount. By the move-up of the third support member 304, the upper ends of the fourth elastic bodies 310*a*, 310*b* come close to the base portion 306*a*. Meanwhile, a distance between the base portion 306*a* of the fourth support member 306 and the cover 43 is always maintained at a constant distance corresponding to the length of the connecting portion 306*b*.

In addition, as illustrated in FIG. 6C, the fourth elastic bodies 310*a*, 310*b* abut on the base portion 306*a* at a time when the move-up amount of the second support member 302 and the third support member 304 reaches the length of the clearance D2. Accordingly, a reaction force in relation to both of the third elastic bodies 308*a*, 308*b* and the fourth elastic bodies 310*a*, 310*b* is applied to the cover 43. In FIG. 6C, the positions of the second support member 302 and the third support member 304 in FIG. 6B are denoted by broken lines for explanation.

After the fourth elastic bodies 310*a*, 310*b* illustrated in FIG. 6C abut on the base portion 306*a*, the second support member 302 and the third support member 304 are further moved up by, for example, a width D3 (see FIG. 6D). As a result, the seal member 94 may be sufficiently crushed by the reaction force in relation to both of the third elastic bodies 308*a*, 308*b* and the fourth elastic bodies 310*a*, 310*b*. That is, the furnace opening may be hermetically sealed by the cover 43. In FIG. 6D, the positions of the second support member 302 and the third support member 304 in FIG. 6C are denoted by broken lines for explanation.

A preferable range for the third elastic modulus of the third elastic bodies 308*a*, 308*b* is the same as that for the first elastic modulus of the first elastic bodies 204*a*, 204*b* in the first exemplary embodiment. Further, a preferable range for the fourth elastic modulus of the fourth elastic bodies 310*a*, 310*b* is the same as that for the second elastic modulus of the second elastic bodies 206*a*, 206*b* in the first exemplary embodiment.

The support mechanism 50*b* according to the second exemplary embodiment may also have a configuration in which a shaft and a bush guide (not illustrated) are disposed.

The clearance D2 is not particularly limited, but may be set within a range of, for example, 1 mm to 20 mm as in the clearance D1.

FIGS. 6A to 6D illustrate an example in which two third elastic bodies and two fourth elastic bodies are arranged two along the circumferential direction of the cover 43 as indicated by the third elastic bodies 308*a*, 308*b* and the fourth elastic bodies 310*a*, 310*b*. Without being limited thereto, however, the present disclosure may be configured such that for example, three or more (e.g., six) third elastic bodies and three or more (e.g., six) fourth elastic bodies may be arranged along the circumferential direction of the cover 43.

As described above, the support mechanism 50*b* according to the second exemplary embodiment includes the third elastic bodies 308*a*, 308*b* configured to allow the cover 43 to elastically abut on the cap 86 and the fourth elastic bodies 310*a*, 310*b* configured to hermetically seal the cover 43 to the cap 86. Therefore, the elastic abutment of the cover 43 on the manifold and the airtightness maintaining property may be achieved at the same time.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A support mechanism for supporting a cover that performs sealing of a furnace opening of a heat treatment furnace or release the sealing by being moved up or down by an elevating unit, the support mechanism comprising:

a first elastic body having a first elastic modulus; and a second elastic body having a second elastic modulus larger than the first elastic modulus, wherein, a reaction force in relation to the first elastic body is applied to the cover when the cover abuts on the furnace opening by being moved up by the elevating unit, and a reaction force in relation to the first elastic body and the second elastic body starts to be applied to the cover after the elevating unit has moved a predetermined distance subsequent to the abuttal of the cover on the furnace opening by the elevating unit, wherein the predetermined distance is larger than zero (0).

2. The support mechanism of claim 1, further comprising:

a first support member provided to be spaced downwardly apart from the cover and configured to be moved up/down when the elevating unit is moved up/down, wherein the first elastic body is in contact with the cover at one end, and in contact with a first surface of the first support member facing the cover at the other end, and the second elastic body is in contact with the first surface of the first support member at one end.

3. The support mechanism of claim 1, further comprising:

a second support member provided to be spaced downwardly apart from the cover and configured to be moved up/down when the elevating unit is moved up/down;

a third support member provided to be spaced downwardly apart from the second support member and configured to be moved up/down when the elevating unit is moved up/down; and a fourth support member including a base portion provided between the second support member and the third support member and a connecting portion connecting the base portion and the cover such that a distance between the base portion and the cover is set to be a predetermined distance, wherein the first elastic body is in contact with the cover at one end, and in contact with a second surface of the second support member facing the cover at the other end, and the second elastic body is in contact with a third surface of the third support member facing the base portion at one end.

4. The support mechanism of claim 1, wherein the first elastic modulus is in a range of 35 $kgf/cm^2$ to 400 $kgf/cm^2$, and the second elastic modulus is in a range of 100 $kgf/cm^2$ to 1,500 $kgf/cm^2$.

5. The support mechanism of claim 1, wherein a ratio of the first elastic modulus to the second elastic modulus is in a range of 2 to 20.

6. A substrate processing apparatus comprising:

a heat treatment furnace;

a cover configured to perform sealing of a furnace opening of the heat treatment furnace or release the sealing;

a support mechanism configured to support the cover; and an elevating unit configured to move up/down the cover through the support mechanism, wherein the support mechanism includes:

a first elastic body having a first elastic modulus; and a second elastic body having a second elastic modulus larger than the first elastic modulus, and a reaction force in relation to the first elastic body is applied to the cover when the cover abuts on the furnace opening by being moved up by the elevating unit, and a reaction force in relation to the first elastic body and the second elastic body starts to be applied to the cover after the elevating unit has moved a predetermined distance subsequent to toe abuttal of the cover on the furnace opening by the elevating unit, wherein the predetermined distance is larger than zero (0).

* * * * *